US010052001B2

(12) United States Patent
Wolford et al.

(10) Patent No.: US 10,052,001 B2
(45) **Date of Patent: *Aug. 21, 2018**

(54) VACUUM HAVING A METAL DRUM AND A POLYMER BASE

(71) Applicant: Emerson Electric Co., St. Louis, MO (US)

(72) Inventors: John Wolford, Ellisville, MO (US); Mark Tomasiak, St. Peters, MO (US); Jason Hill, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/270,335

(22) Filed: Sep. 20, 2016

(65) Prior Publication Data

US 2017/0071428 A1 Mar. 16, 2017

Related U.S. Application Data

(63) Continuation of application No. 14/849,767, filed on Sep. 10, 2015, now Pat. No. 9,668,625.

(51) Int. Cl.

| | |
|---|---|
| ***A47L 5/36*** | (2006.01) |
| ***A47L 5/14*** | (2006.01) |
| ***A47L 9/14*** | (2006.01) |
| ***A47L 7/00*** | (2006.01) |
| ***A47L 9/00*** | (2006.01) |

(52) U.S. Cl.

CPC ..... *A47L 5/365* (2013.01); *A47L 5/14* (2013.01); *A47L 7/0019* (2013.01); *A47L 7/0038* (2013.01); *A47L 7/0042* (2013.01); *A47L 9/009* (2013.01); *A47L 9/0027* (2013.01); *A47L 9/1409* (2013.01); *A47L 9/1463* (2013.01)

(58) Field of Classification Search

CPC ..... A47L 5/14; A47L 5/365; A47L 9/1409; A47L 9/1427; A47L 9/1436; A47L 9/1445; A47L 9/1454; A47L 9/1463; A47L 5/36; A47L 9/14

See application file for complete search history.

(56) References Cited

U.S. PATENT DOCUMENTS

| | | | |
|---|---|---|---|
| 4,222,753 | A | 9/1980 | Mills |
| 5,598,605 | A | 2/1997 | Tomasiak |
| 5,606,769 | A | 3/1997 | Tomasiak et al. |
| 6,170,118 | B1 | 1/2001 | McIntyre |
| 8,732,898 | B2 | 5/2014 | Fry et al. |

*Primary Examiner* — David Redding

(74) *Attorney, Agent, or Firm* — Armstrong Teasdale LLP

(57) ABSTRACT

A vacuum appliance comprising a drum and a vacuum head. The drum may include a base and a cylinder sealed to the base. The vacuum head may include a lid and a blower. The lid preferably includes a portion that is detachably mounted to an open upper end of the drum. The blower may be mounted to, atop, or within the lid. In any case, the blower induces a vacuum within the drum and moves through the vacuum. The base or the cylinder may include a drain to drain fluid and debris contained within the drum. The lid may include a lower portion sealed to and defining the open upper end of the drum. The cylinder or the lid may include an air inlet through which the blower draws air and entrained debris.

18 Claims, 5 Drawing Sheets

VACUUM HAVING A METAL DRUM AND A POLYMER BASE

CROSS REFERENCE TO RELATED APPLICATIONS

This application claims priority to, and is a continuation of, U.S. patent application Ser. No. 14/849,767, filed Sep. 10, 2015, now U.S. Pat. No. 9,668,625, the contents of which are incorporated herein by reference in its entirety.

STATEMENT REGARDING FEDERALLY SPONSORED RESEARCH OR DEVELOPMENT

Not applicable.

BACKGROUND OF THE INVENTION

Field of the Invention

The inventions disclosed and taught herein relate generally to vacuum appliances; and more specifically related to wet/dry vacuums.

Description of the Related Art

U.S. Pat. No. 8,732,898 discloses a "drum vacuum cleaner [that has a] stainless steel wall that that substantially surrounds a molded inner tank that extends downwardly from a tank collar. The lower end of the wall is positioned between an inward-facing edge of a recess on a wheeled base and an outward-facing edge on the molded inner tank, and is supported on a supporting face on the base that also supports the tank. The upper end of the wall is positioned within a downward-opening slot in the tank collar. When the molded inner tank is connected to the base, the metal wall is trapped in place between the tank collar and the base, providing an exposed stainless steel section that is at least three inches in height and can extend to within less than 1" of the vacuum cleaner head."

The inventions disclosed and taught herein are directed to wet/dry vacuums.

BRIEF SUMMARY OF THE INVENTION

The objects described above and other advantages and features of the invention are incorporated in the application as set forth herein, and the associated appendices and drawings, related to systems for wet/dry vacuums.

In accordance with the present disclosure, we have created a vacuum appliance comprising a drum and a vacuum head atop the drum. The drum may include a base and a cylinder sealed to the base. The vacuum head may include a lid and a blower, which may be integral or separable. The lid preferably includes at least a portion that is detachably mounted to an open upper end of the drum. The blower may be mounted to, atop, or within the lid. In any case, the blower induces a vacuum within the drum and moves through the vacuum. The base or the cylinder may include a drain to drain fluid and debris contained within the drum. The lid may include a lower portion sealed to and defining the open upper end of the drum. The cylinder or the lid may include an air inlet through which the blower draws air and entrained debris.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
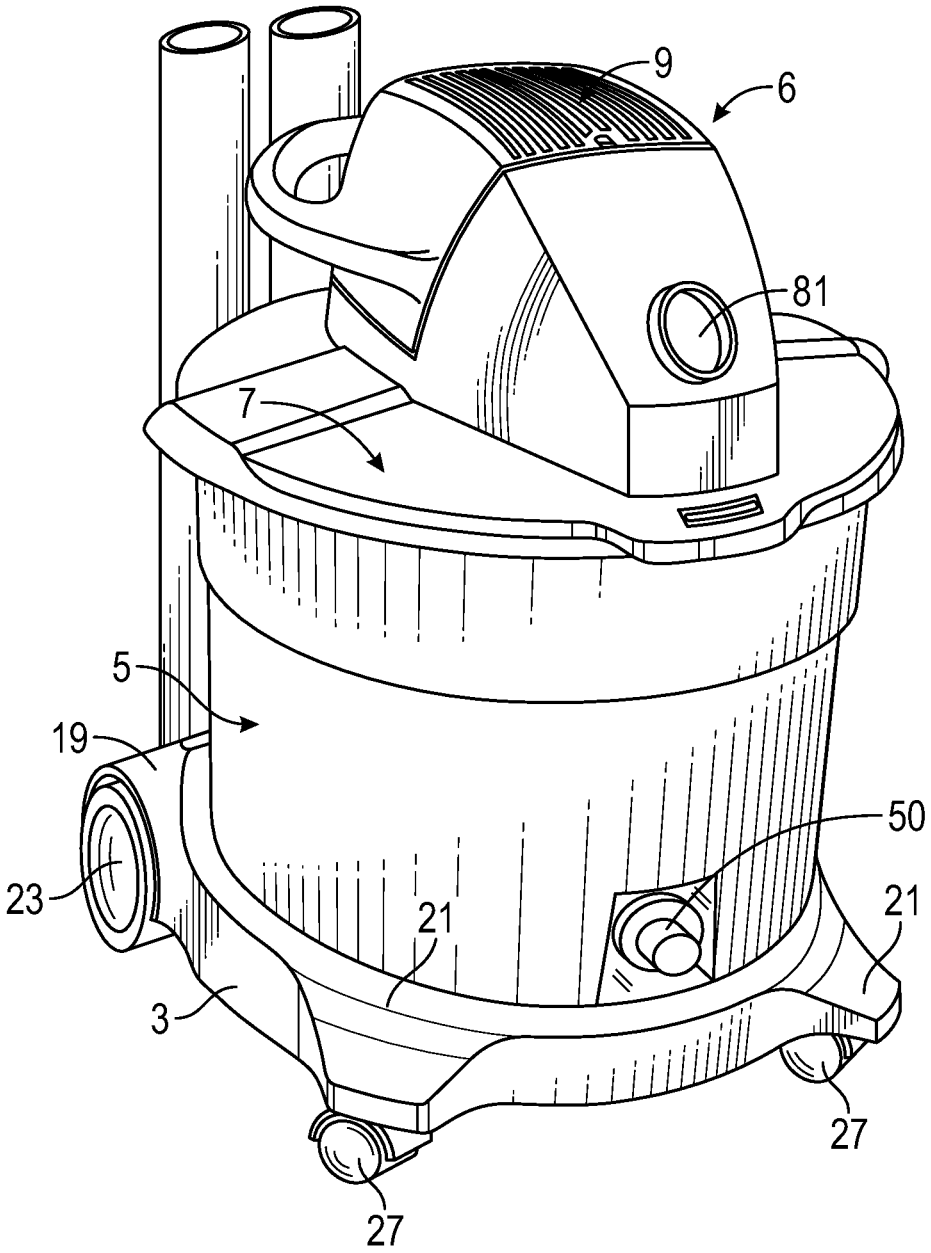
FIG. 1 illustrates a front perspective view of a wet/dry utility vacuum cleaner of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

We have created a vacuum appliance comprising a drum, a lid, and a blower. The drum may include a base and a cylinder sealed to the base. The lid preferably includes a portion that is detachably mounted to an open upper end of the drum. The blower may be mounted to, atop, or within the lid. In any case, the blower induces a vacuum within the drum and moves through the vacuum. The base or the cylinder may include a drain to drain fluid and debris contained within the drum. The lid may include a lower portion sealed to and defining the open upper end of the drum. The cylinder or the lid may include an air inlet through which the blower draws air and entrained debris.

Figure 2:
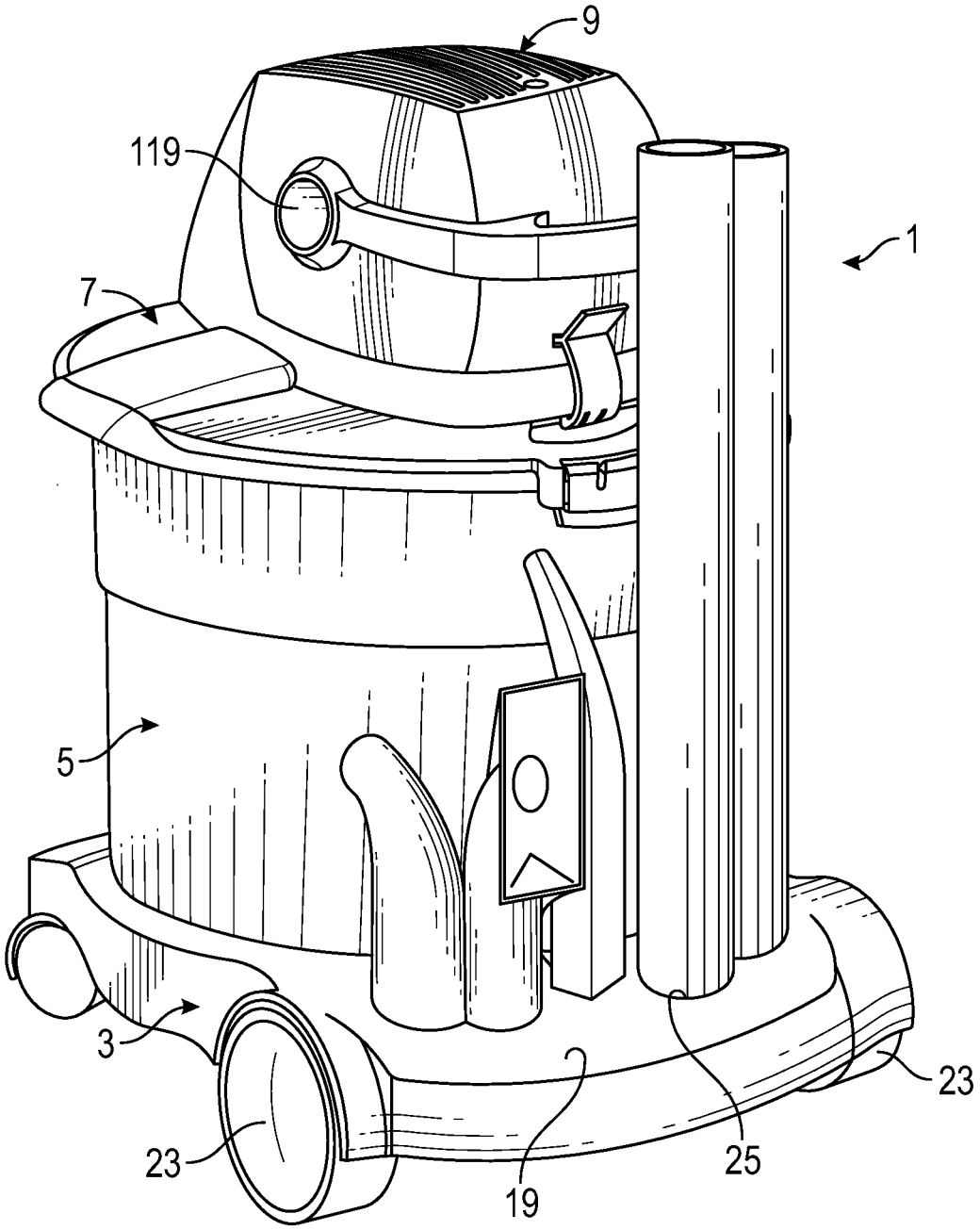
FIG. 2 illustrates a rear perspective view of the wet/dry utility vacuum cleaner illustrated in FIG. 1.

The wet/dry utility vacuum cleaner 1 shown in FIGS. 1-2 of the drawings includes a base 3, a utility vacuum drum 5 supported by the base 3, and a vacuum head 6. The head 6 may comprise a lid 7 that removably covers an open upper end of the vacuum cleaner drum 5, and a blower 9 within the lid 7. The base may take the form of a tool caddy such as that described in U.S. Pat. No. 5,598,605, which is incorporated herein by specific reference.

For example, the base 3 may be provided with a rear bumper 19 and front bumper sections 21. The rear bumper 19 performs two functions. First, it serves as a bumper element for spaced wheels 23. Secondly, may provide a plurality of spaced tool openings 25 for receiving vacuum tools as illustrated in FIGS. 1-2 of the drawings. The spaced front bumper sections 21 may be adapted to overlie and protect an individual wheel caster mounted within the bumper section 21 in a similar manner. The rear bumper 19 and the front bumper sections 21 protect the rear wheels 23 and the wheel casters 27, regardless of direction of movement of the base 3. Of course, rather than axial mounted wheels 23 and casters 27, the vacuum 1 may include only wheels 23 or casters 27, in the front and back. In some embodiments, may not have either wheels 23 or casters 27. As such, bumper sections 21 may provide stable floor mounts or legs.

Figure 3:
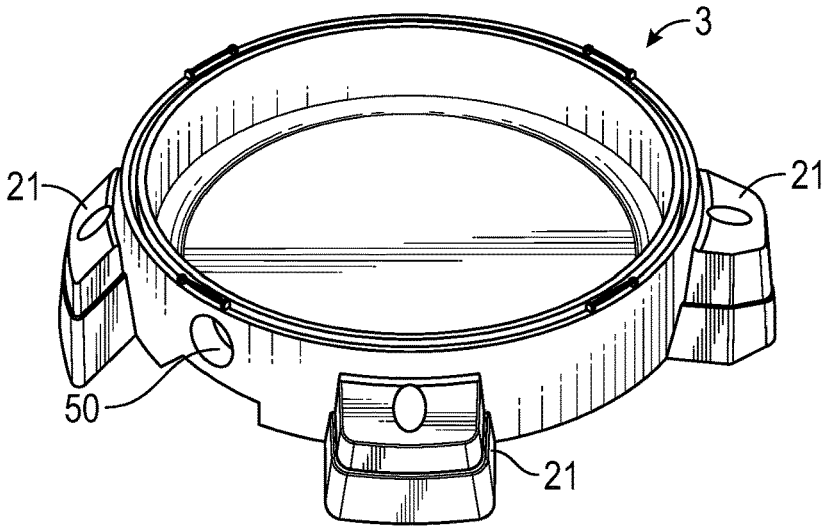
FIG. 3 illustrates a base of the present invention.
Figure 4:
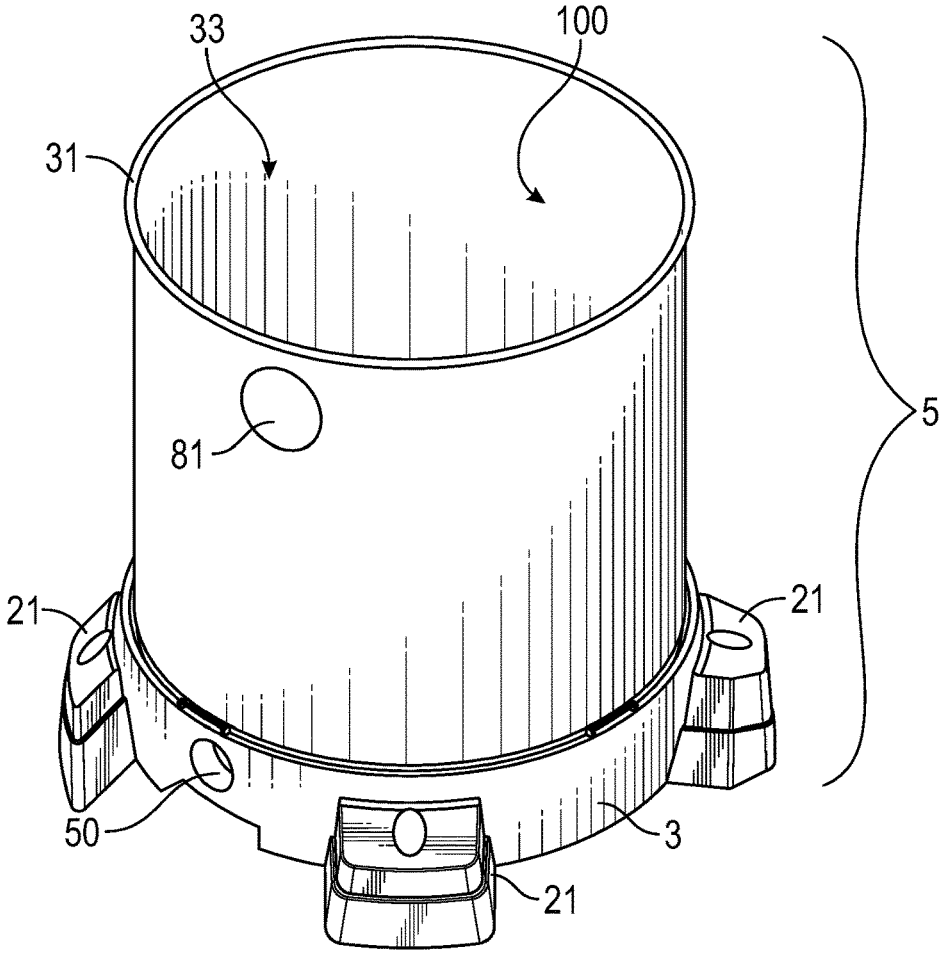
FIG. 4 illustrates a drum of the present invention.

Similarly, the lid 7 and blower 9 may be separable, such as those described in U.S. Pat. No. 5,606,769, which is incorporated herein by specific reference. Referring also to FIGS. 3-4, the lid 7, or a portion thereof, is detachably mounted to an enlarged rim 31 of the drum 5 and extends across the open upper end 33 of the drum 5.

Drums of prior designs of wet/dry vacuum cleaners were often molded with an integral floor, such that the drum and floor were one piece made of the same material. In most cases, a base was separately molded of the same or similar material. However, we have found that there are benefits to forming the sidewall(s) 100 of the drum 5 separately from the base 3, which forms a floor of the drum 5, and of different materials. More specifically, in at least some embodiments, a base 3 molded from a polymer material forms a floor of the drum 5 and a cylinder 100 made of metal, such as stainless steel, aluminum, or other metal, forms the sidewall(s) of the drum 5.

Figure 6:
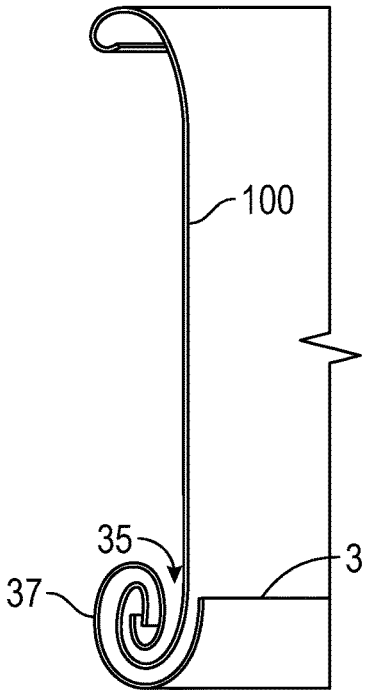
FIG. 6 illustrates one technique for forming a drum of the present invention.
Figure 7:
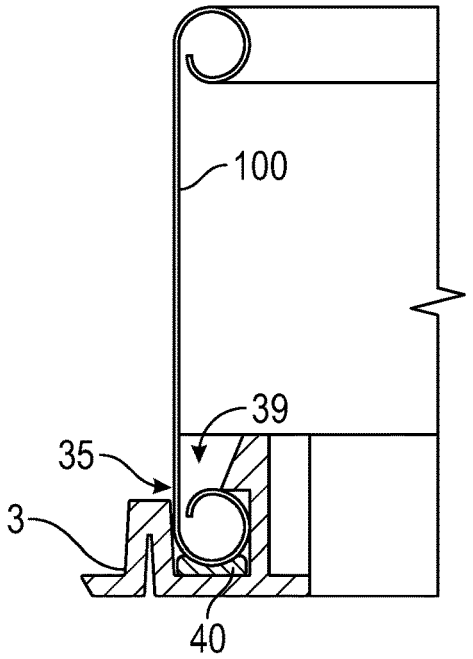
FIG. 7 illustrates another technique for forming a drum of the present invention.

The rim 31 of the drum 5 is preferably formed by rolling an upper edge of the cylinder 100. Similarly, as shown in FIGS. 6-7, a lower edge 35 of the cylinder 100 may also be rolled. In this manner, the cylinder 100 may sealingly engage a complimentary roll 37 in the base, thereby sealing the cylinder 100 to the base 3. Alternatively, the rolled lower edge 35 of the cylinder 100 may snap fit into a socket 39 in the base, thereby sealing the cylinder 100 to the base 3. In still other cases, the base 3 may be over-molded to the cylinder 100, with or without the rolled lower edge 35. In any case, the cylinder 100 may be sealed to the base 3 using a sealing member 40, such as an adhesive and/or a gasket, between the two.

Figure 5:
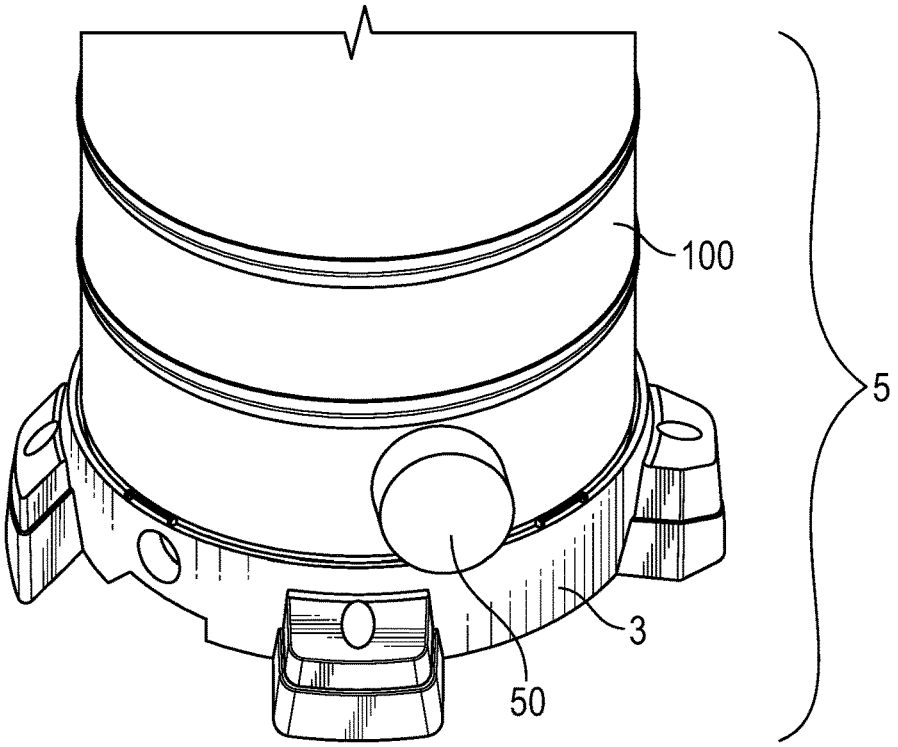
FIG. 5 also illustrates a drum of the present invention.

Some embodiments of the vacuum 1 may include a drain 50 in a lower region of the drum, to drain fluid and/or debris from the drum 5. For example, the drain 50 may be through the cylinder 100 of the drum 5, as shown in FIG. 5. Alternatively, the drain 50 may be located in an upper portion of the base 3, as shown in FIGS. 3-4, thereby reducing or eliminating penetrations through the cylinder 100 of the drum 5. This has the added benefit of reducing possible leak points and failure modes; and simplifies manufacturing.

As can be appreciated, and explained in more detail in U.S. Pat. No. 5,606,769, the vacuum 1 includes a vacuum inlet 81 that opens up into the interior of the vacuum cleaner drum 5. The vacuum inlet 81 receives a vacuum hose (not shown), typically in a friction fit assembled relationship.

As can be seen in FIG. 4, the inlet 81 may be through the cylinder 100 of the drum 5. Alternatively, the inlet 81 may be located in the lid 7, as shown in FIG. 1, thereby reducing or eliminating penetrations through the cylinder 100 of the drum 5. This has the added benefit of reducing possible leak points and failure modes; and simplifies manufacturing.

Figure 8:
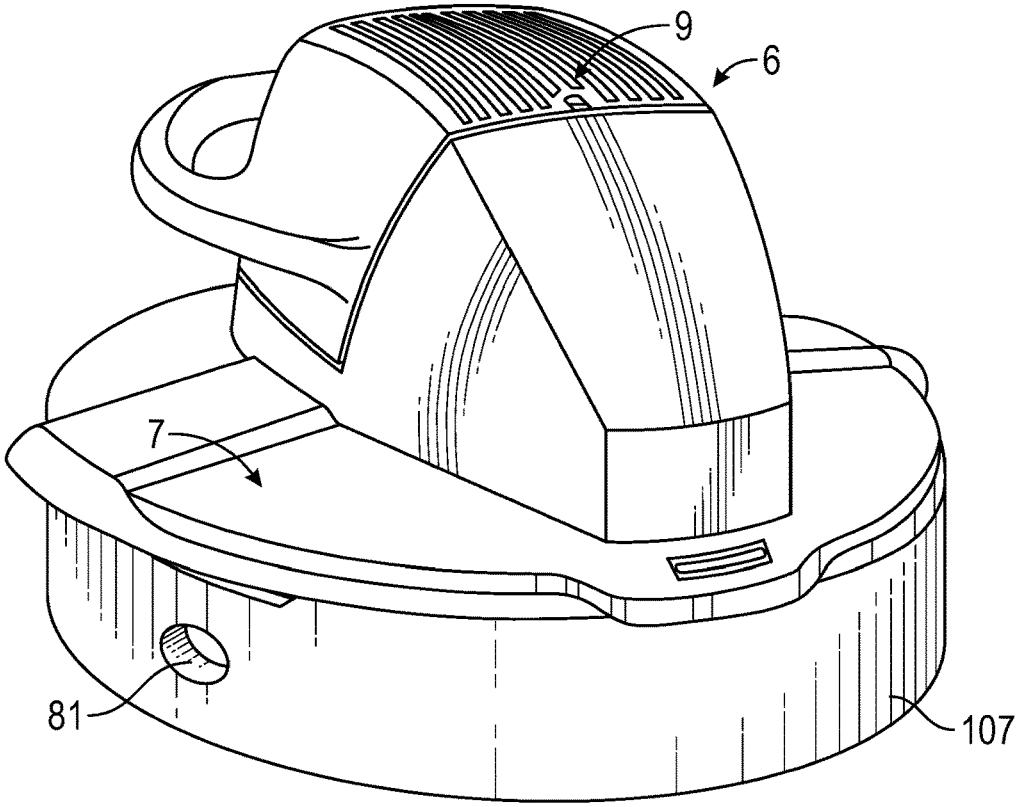
FIG. 8 illustrates a portion of a vacuum head of the present invention.

For example, as shown in FIG. 8, a lower portion 107 of the lid 7 may resemble an inverted example of the base 3 shown in FIG. 3, with the blower 9 and any detachable portions of the lid 7 and blower 9 being mounted thereto. In this case, the lower portion 107 of the lid 7 would likely not include the bumper sections 21, wheels 23, or casters 27 (shown in FIG. 3), but may include other structure, such as tool holders. Of course, the lower portion 107 of the lid 7 would preferably be sealed to the cylinder 100 in any of the above described manners, as shown in FIG. 6 or FIG. 7, with or without adhesive 40 and/or a gasket 40, and/or have the lower portion 107 of the lid 7 over-molded to the cylinder 100. In any case, the lower portion 107 of the lid 7 may include the inlet 81.

Additionally, as can be appreciated, and explained in more detail in U.S. Pat. No. 5,606,769, the vacuum 1 preferably includes one or more exhaust ports 119. The exhaust 119 may be formed in the lid 7 or the blower 9 itself. In any case, the blower 9 induces a vacuum within the drum, and suction at the inlet 81, by moving air through the inlet 81, the drum 5, itself 9, and then out through the exhaust 119.

In summation, the drum 5 of the present invention includes a metal cylindrical portion 100, which forms the sidewall(s) of the drum. The base 3 and at least portions of the lid 7, are preferably made of a molded polymer. The cylinder 100 of the drum 5 therefore distinct from, but sealed to the base 3. Similarly, cylinder 100 of the drum 5 distinct from, but connected to the lid 7, and in some cases actually sealed to a lower portion of the lid. In fact, in at least some embodiments of the present inventions, no portion of the base 3 extends to the open upper end of the drum 5 and/or lid 7. Similarly, in at least some embodiments of the present inventions, no portion of the lid 7 extends to a lower portion of the drum 5 and/or the base 3. Specifically, in at least some embodiments of the present inventions, the cylinder 100 separates the base 3 and the open upper end of the drum 5 and/or lid 7. It can be seen that, while portions of the base 3 and lid 7 may extend upwardly and downwardly, respectively, at least a portion of the sidewalls of the drum 5 are formed exclusively by the metal cylinder 100 which therefore completely replaces, not just supplements, the polymer sidewalls of the prior art devices.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A vacuum appliance comprising;

a drum, including— a polymer base, a metal cylinder secured to the base, and a seal between the base and the cylinder; and a polymer lid mounted to an open upper end of the cylinder, wherein the lid includes a vacuum head.

2. The appliance as set forth in claim 1, wherein no portion of the polymer base extends to the lid.

3. The appliance as set forth in claim 1, wherein no portion of the polymer lid extends to the base of the drum.

4. The appliance as set forth in claim 1, wherein the metal cylinder separates the base and the lid, such that the base and the lid are not in direct contact.

5. The appliance as set forth in claim 1, wherein the base, cylinder, and seal are configured to contain fluid within the drum.

6. The appliance as set forth in claim 1, wherein the base includes a drain to drain fluid and debris contained within the drum.

7. The appliance as set forth in claim 1, wherein the seal comprises a gasket between the base and the cylinder.

8. The appliance as set forth in claim 1, wherein the seal comprises an adhesive between the base and the cylinder.

9. The appliance as set forth in claim 1, wherein the seal comprises molding the base about a lower portion of the cylinder thereby providing the seal between the base and the cylinder.

10. The appliance as set forth in claim 1, wherein the cylinder forms a wall of the drum and the base forms a floor of the drum.

11. The appliance as set forth in claim 1, wherein the lid includes a lower portion defining the open upper end of the drum.

12. The appliance as set forth in claim 11, wherein no portion of the base extends to the lid, such that the base and the lid are not in direct contact.

13. The appliance as set forth in claim 11, wherein no portion of the lid extends to the base, such that the base and the lid are not in direct contact.

14. The appliance as set forth in claim 11, wherein the cylinder separates the base and the lid, such that the base and the lid are not in direct contact.

15. The appliance as set forth in claim 11, wherein the lid includes a blower and an air inlet through which the blower draws air and entrained debris.

16. The appliance as set forth in claim 11, wherein the drum includes a drain in the base and an air inlet in the lid, such that there are no penetrations through a sidewall of the cylinder.

17. The appliance as set forth in claim 1, wherein the lid includes a blower, and wherein the cylinder includes an air inlet through which the blower draws air and entrained debris.

18. The appliance as set forth in claim 1, wherein the cylinder includes a drain to drain fluid and debris contained within the drum.

* * * * *